US007540692B2

(12) United States Patent
Munk et al.

(10) Patent No.: US 7,540,692 B2
(45) Date of Patent: Jun. 2, 2009

(54) SYSTEM, METHOD, AND APPARATUS FOR LOCKING DOWN TENDON OR RISER MOORINGS

(75) Inventors: Brian N. Munk, Houston, TX (US); Joseph W. Pallini, Jr., Tomball, TX (US); Edward A. Mendoza, Houston, TX (US); Uday Idnani, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 390 days.

(21) Appl. No.: 11/455,054

(22) Filed: Jun. 16, 2006

(65) Prior Publication Data

US 2007/0292213 A1 Dec. 20, 2007

(51) Int. Cl.
*B63B 21/50* (2006.01)

(52) U.S. Cl. ..... 405/224.2; 405/224; 405/223.1

(58) Field of Classification Search ..... 405/224, 405/224.2, 195.1, 223.1
See application file for complete search history.

(56) References Cited

U.S. PATENT DOCUMENTS 4,059,148 A * 11/1977 Blomsma ..... 166/359
4,277,875 A * 7/1981 Worrell ..... 29/253
4,491,439 A * 1/1985 Watkins ..... 405/224
4,869,615 A * 9/1989 Galle ..... 405/224
4,907,914 A * 3/1990 Gunderson et al. ..... 405/224
4,968,183 A * 11/1990 Hannus et al. ..... 405/224
5,480,521 A * 1/1996 Snyder et al. ..... 405/224
5,755,533 A * 5/1998 Snyder et al. ..... 405/224
5,984,585 A 11/1999 Pallini, Jr. et al.
6,595,293 B2 * 7/2003 Carter ..... 405/224

FOREIGN PATENT DOCUMENTS

GB 2167367 A 5/1986
GB 2178101 A 2/1987

* cited by examiner

*Primary Examiner*—Frederick L Lagman
(74) *Attorney, Agent, or Firm*—Bracewell & Giuliani

(57) ABSTRACT

A tendon or riser connector has a separate lock-down device that overrides the connector's ability to unlock if the riser or tendon goes slack. The locking device has blocks that are radially actuated through a hole in a receptacle to engage a profile in the connector. When the blocks are pushed in, they prevent the connector from moving downward, and thus prevent any unlocking of the connector. The blocks are secured with pivotable gates that engage and retain the blocks in both positions.

26 Claims, 6 Drawing Sheets

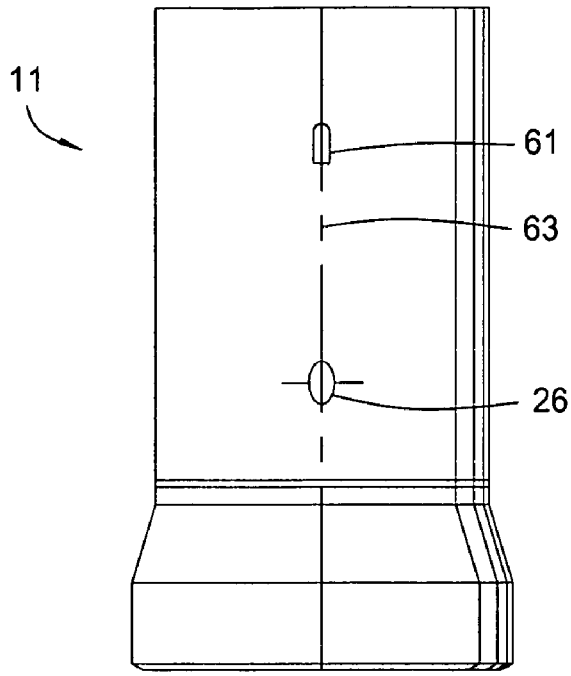
FIG. 3
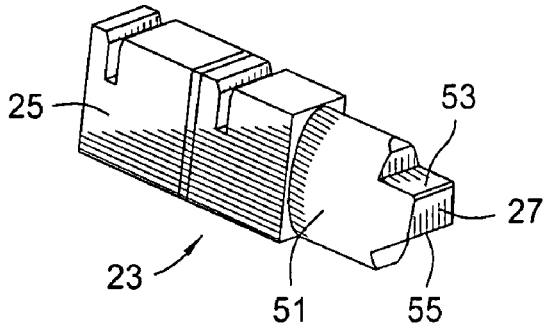
FIG. 4
FIG. 6
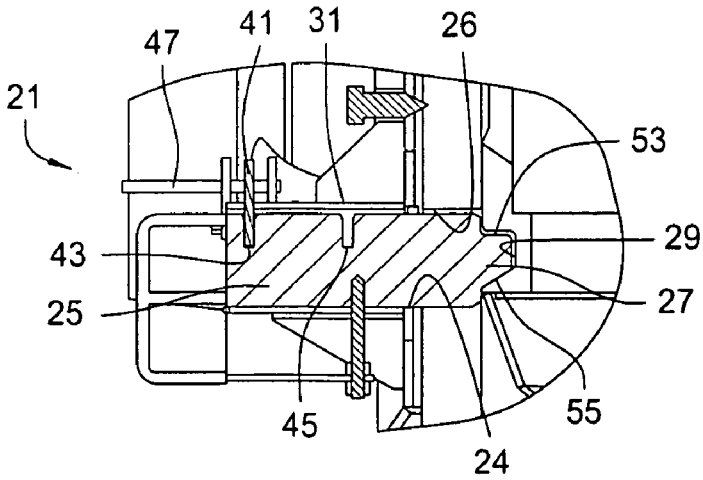

SYSTEM, METHOD, AND APPARATUS FOR LOCKING DOWN TENDON OR RISER MOORINGS

BACKGROUND OF THE INVENTION

1. Technical Field

The present invention relates in general to tendon or riser mooring connectors and, in particular, to an improved system, method, and apparatus for locking down a tendon or riser mooring.

2. Description of the Related Art

In the prior art, one type of tendon or riser mooring connector for platforms typically operates with vertical motion only. At the sea floor, the connector is lowered a short distance into a receptacle mounted to the sea floor, lifted vertically, and locks into a profile in the receptacle. If lowered a longer distance into the receptacle, such as when the riser or tendon goes slack, an unlocking mechanism allows the connector to release from the receptacle. Under extreme operating conditions, such as hurricanes, the connector can be accidentally unlocked due to motion of the platform at the surface and severely jeopardize the safety of personnel and equipment. Thus, an improved solution for securing the connections between tendon or riser moorings and receptacles would be desirable.

SUMMARY OF THE INVENTION

One embodiment of a system, method, and apparatus for locking down a tendon or riser mooring incorporates a separate lock-down device that overrides the connector's ability to unlock if the riser or tendon goes slack. The locking device is carried on the outside of the receptacle or on a separate sleeve. It comprises one or more pins or blocks that are radially actuated by a diver, remotely-operated vehicle (ROV), a hydraulic drive mechanism, or the like, and extends through a hole in the receptacle. A profile on the end of the block interfaces with a mating turned profile on the guide sleeve below the mooring connector. When the block is pushed in, it prevents the connector from moving downward, and thus prevents any unlocking of the connector.

In one embodiment, the block is located inside a box and is restrained in the inward or locked and outward or unlocked positions by one or more locating pins. The locating pin is inserted into the block vertically. In another embodiment, the block is carried in a cradle on the exterior of the receptacle or a separate sleeve. To lock the device, the diver or ROV lifts the block out of the cradle and places it into the hole in the receptacle and pushes it into engagement with a grooved guide on the mooring connector. To prevent accidental loss of the block or locating pin, they may be attached to the receptacle or sleeve by a cable or chain. Alternatively, a pivotable gate may be used to engage and retain the block in either position via a lock down groove in the guide sleeve.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention, which will become apparent, are attained and can be understood in more detail, more particular description of the invention briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

FIG. 3 is a side view of one embodiment of a receptacle for the bottom mooring of FIG. 1 and is constructed in accordance with the present invention;

FIG. 4 is an isometric view of one embodiment of a radially-movable member for the bottom mooring of FIG. 1 and is constructed in accordance with the present invention;

FIG. 6 is a sectional side view of the securing means of FIG. 5*a* in the engaged position and is constructed in accordance with the present invention;

DETAILED DESCRIPTION OF THE INVENTION

Figure 1:
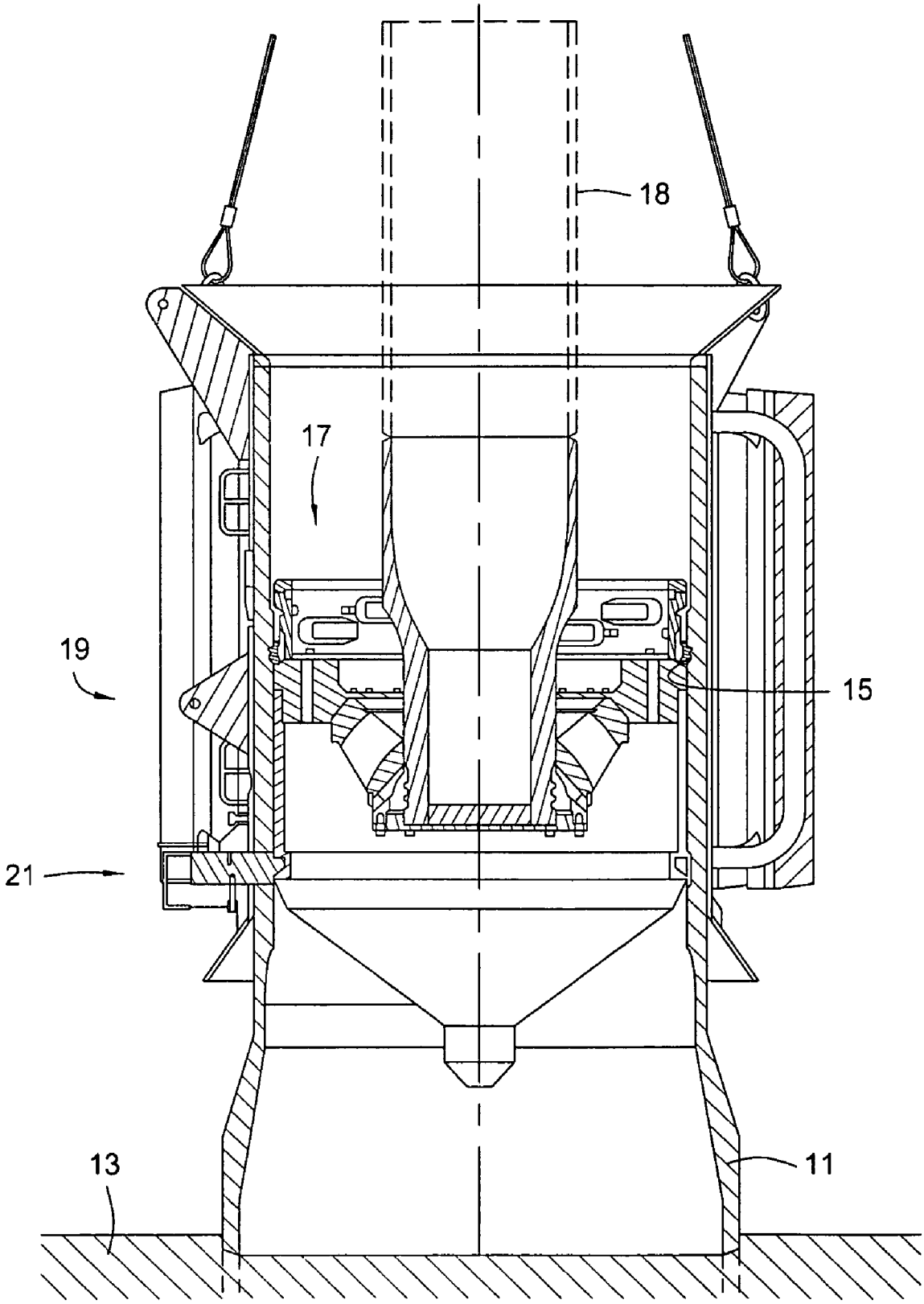
FIG. 1 is a sectional side view of one embodiment of a bottom mooring and is constructed in accordance with the present invention.
Figure 2:
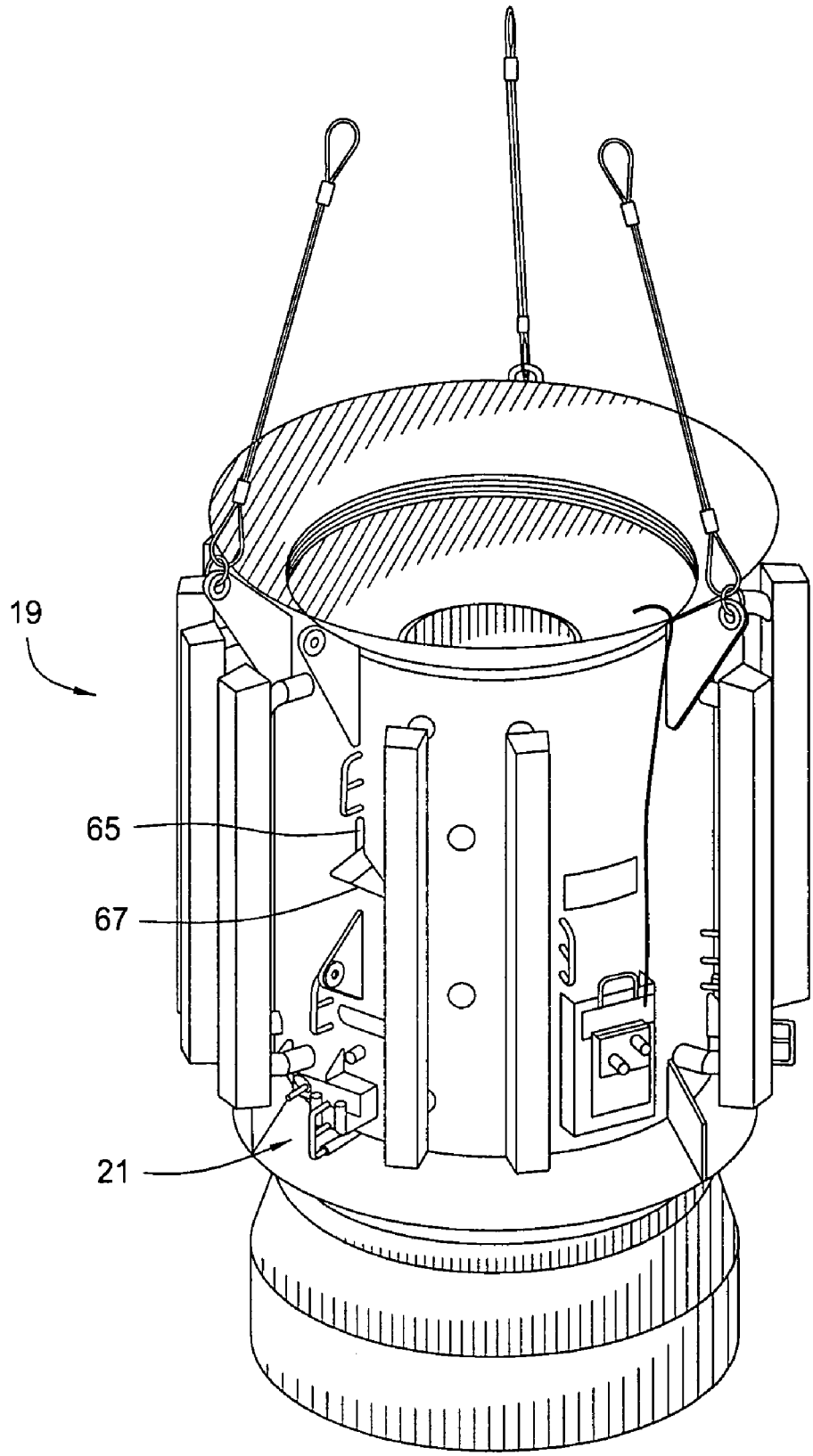
FIG. 2 is an isometric view of one embodiment of a sleeve for the bottom mooring of FIG. 1 and is constructed in accordance with the present invention.

Referring to FIGS. 1-3, one embodiment of a system, method, and apparatus for securing a mooring connection for a tendon or riser is disclosed. A mooring receptacle 11 is located on the sea floor 13 and has an interior locking profile 15. A bottom connector 17 has a tubular member 18 (e.g., a tendon or riser) extending therefrom to a platform at a sea surface (not shown). The bottom connector 17 is secured to the interior profile 15 in the receptacle 11.

In the embodiment shown, the bottom connector 17 may be connected to and disconnected from the receptacle 11 strictly via vertical motion. In this way, the bottom connector 17 locks into the receptacle 11 by being lowered into the receptacle for a limited distance, past a locked position, but not enough to engage an unlocked position, and then raised back up to the locked position. The bottom connector 17 is unlocked from the receptacle 11 by being lowered beyond the locked position to the unlocked position, after which the bottom connector 17 may be removed from the receptacle 11. An optional sleeve 19 (e.g., anode sleeve) may be lowered onto and secured to an exterior of the receptacle 11 to provide cathodic protection for the installation.

The invention also comprises securing means 21 for preventing the bottom connector 17 from being lowered to the unlocked position and so that it cannot be unlocked from the receptacle 11. In one embodiment, the securing means 21 is separate and spaced apart from the bottom connector 17. The securing means 21 may be mounted to an exterior of the receptacle 11, or anode sleeve 19 (if present). In this disclosure, the phrase "exterior to the receptacle" or "exterior surface of the receptacle" may include the exterior or exterior surface of the optional sleeve 19, if present. The securing means 21 extends radially through holes 24, 26 (FIG. 6) in the anode sleeve 19 and the receptacle 11, respectively, into engagement with the bottom connector 17.

Figure 5A:
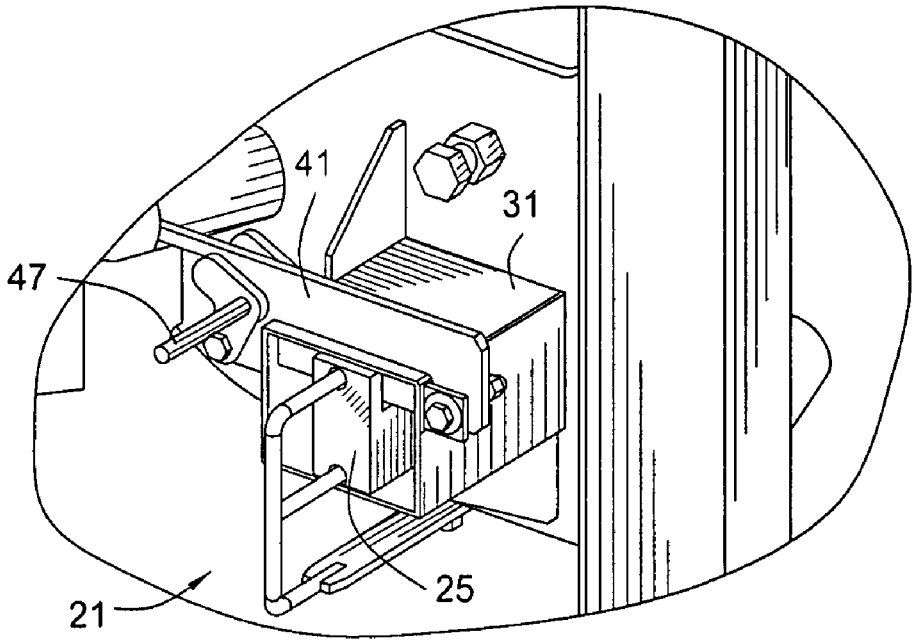
FIGS. 5*a* and 5*b* are isometric views of one embodiment of securing means for the radially-movable member of FIGS. 4 and 6, showing engaged and disengaged positions, respectively, and is constructed in accordance with the present invention.
Figure 5B:
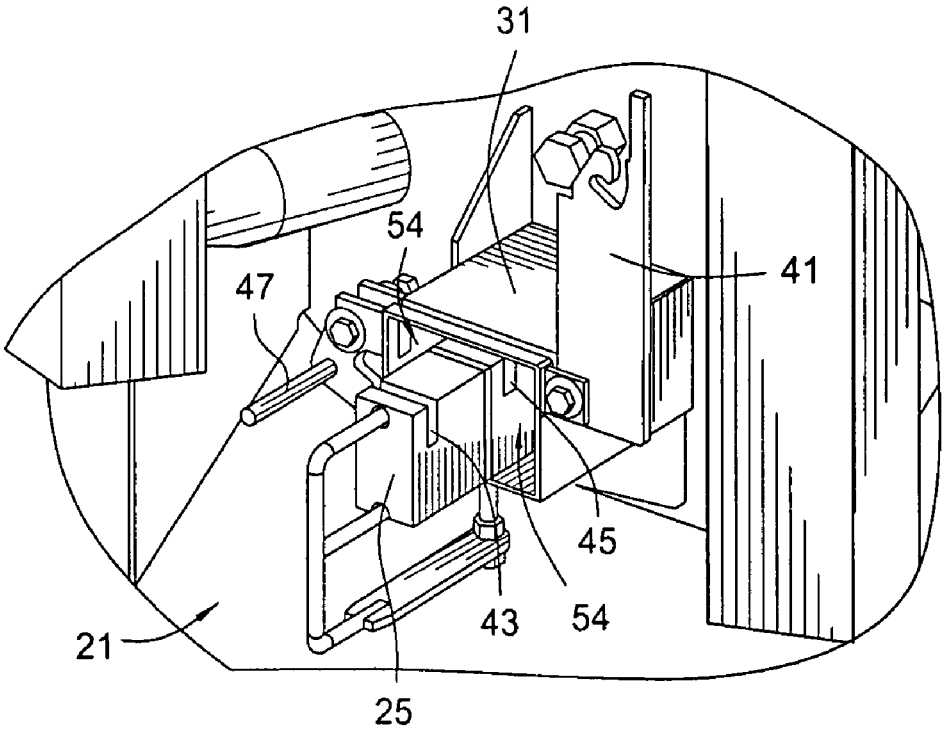

In the embodiment shown, the securing means 21 comprises a plurality of radially movable members 23 (FIG. 4) having an engaged position (FIGS. 1, 2, and 5*a*) wherein the radially movable members 23 restrain the bottom connector 17 from vertical motion relative to the receptacle 11. The radially movable members 23 also have a disengaged position (FIG. 5*b*) wherein the radially movable members 23 permit vertical motion of the bottom connector 17 relative to the receptacle 11. The radially movable members 23 may be independently actuated by a device such as a diver, remotely-operated vehicle (ROV), or a hydraulic drive mechanism.

Figure 7A:
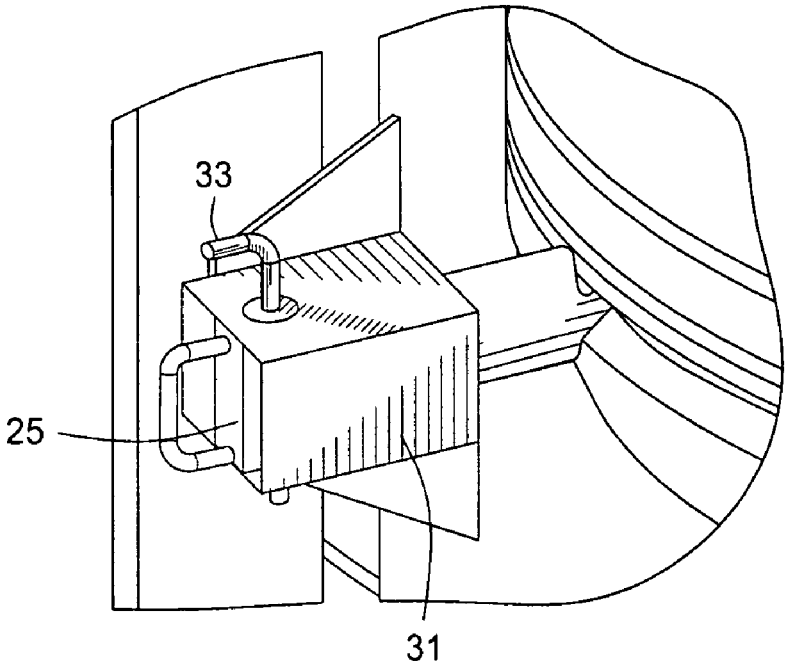
FIGS. 7*a* and 7*b* are isometric views of another embodiment of securing means for the radially-movable member of FIGS. 4 and 6, showing engaged and disengaged positions, respectively, and is constructed in accordance with the present invention.
Figure 7B:
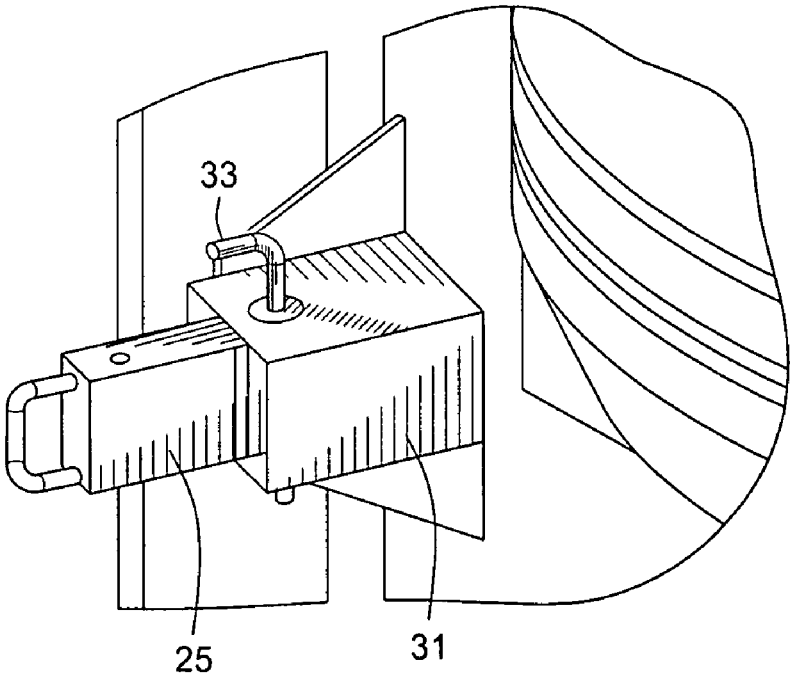

In one embodiment, each of the radially movable members 23 comprises a block 25 (FIGS. 4 and 6) having a profile 27 that extends through hole 26 in the receptacle 11. The profile 27 on the block 25 interfaces with a mating profile 29 on the bottom connector 17 and, in the engaged position (FIGS. 1, 2, and 5*a*), prevents the bottom connector 17 from moving downward to prevent unlocking of the bottom connector 17 relative to the receptacle 11. In the embodiment shown, each block 25 is located inside a box 31 mounted exterior to the receptacle 11 (or, e.g., on the sleeve 19). The blocks 25 are restrained from removal from the boxes 31 in both the engaged and disengaged positions by, for example, locating pins 33 (FIGS. 7*a* and 7*b*). The locating pins 33 may be attached to the receptacle via chains or cables. The locating pins 33 may be independently actuated as described above for radially movable members 23.

Alternatively (FIGS. 5*a* and 5*b*), a pivotable gate 41 is mounted exterior to the receptacle 11 (or, e.g., sleeve 19) for each radially movable member 23 (e.g., block 25). The pivotable gates 41 selectively retain the radially movable members 23 in both the engaged and disengaged positions via a pair of spaced-part grooves 43, 45, respectively (FIG. 5*b*), by engaging the pivotable gates 41. For illustration purposes in FIG. 5*b*, the gate 41 is shown in a lifted position, but readily seats in groove 45 to retain block 25 in the disengaged position. In one embodiment, a pivotable redundant pin 47 may be used for each of the pivotable gates 41 for engaging and securing the pivotable gates 41 in both the engaged and disengaged positions of block 25. The redundant pins 47 seat in notches formed in the gates 41 for positive retention thereof. Redundant pins 47 provide an additional level of security to maintain the gates 41 engaged with blocks 25 in both the engaged and disengaged positions. The pivotable gates 41 and redundant pins 47 may be independently actuated as described above for radially movable members 23.

In one embodiment (FIG. 4), each block 25 has an elliptical body 51 that is complementary to the elliptical hole 26 (FIG. 3) in the receptacle 11. The block profile 27 comprises a radial tooth having a downward-sloping upper surface 53 (e.g., approximately 3°) and an upward sloping lower surface 55 (e.g., approximately 45°) that exceeds an angle of inclination of the downward-sloping upper surface 53. Again, the shape of block profile 27 is complementary to mating profile 29 (FIG. 6) in bottom connector 17.

In one embodiment, a sufficient gap 54 (FIG. 5*b*) between block 25 and box 31 is incorporated to allow adjustment for vertical and lateral mismatch between the assembly of block 25, box 31, and the hole 26. A sufficient vertical gap between profile 53 and profile 29 is provided for vertical mismatch between block 25/box 31 and connector 17.

A key 61 (FIG. 3) may be formed on and extend radially from an exterior surface of the receptacle 11. A stripe 63 (e.g., painted) may be formed on the exterior surface of the receptacle 11 and extend vertically downward from the key 61. An aperture 65 (FIG. 2) formed in the sleeve 19 has a guide member 67 for receiving the key 61 to assist in rotationally aligning the sleeve 19 relative to the receptacle 11. The stripe 63 facilitates rotational alignment with the aperture 65 by being visible below the sleeve 19 as the sleeve 19 is lowered onto the receptacle 11. In this way, the stripe 63 provides visual reference to position the key 61 in the guide member 67 of the aperture 65.

Figure 8:
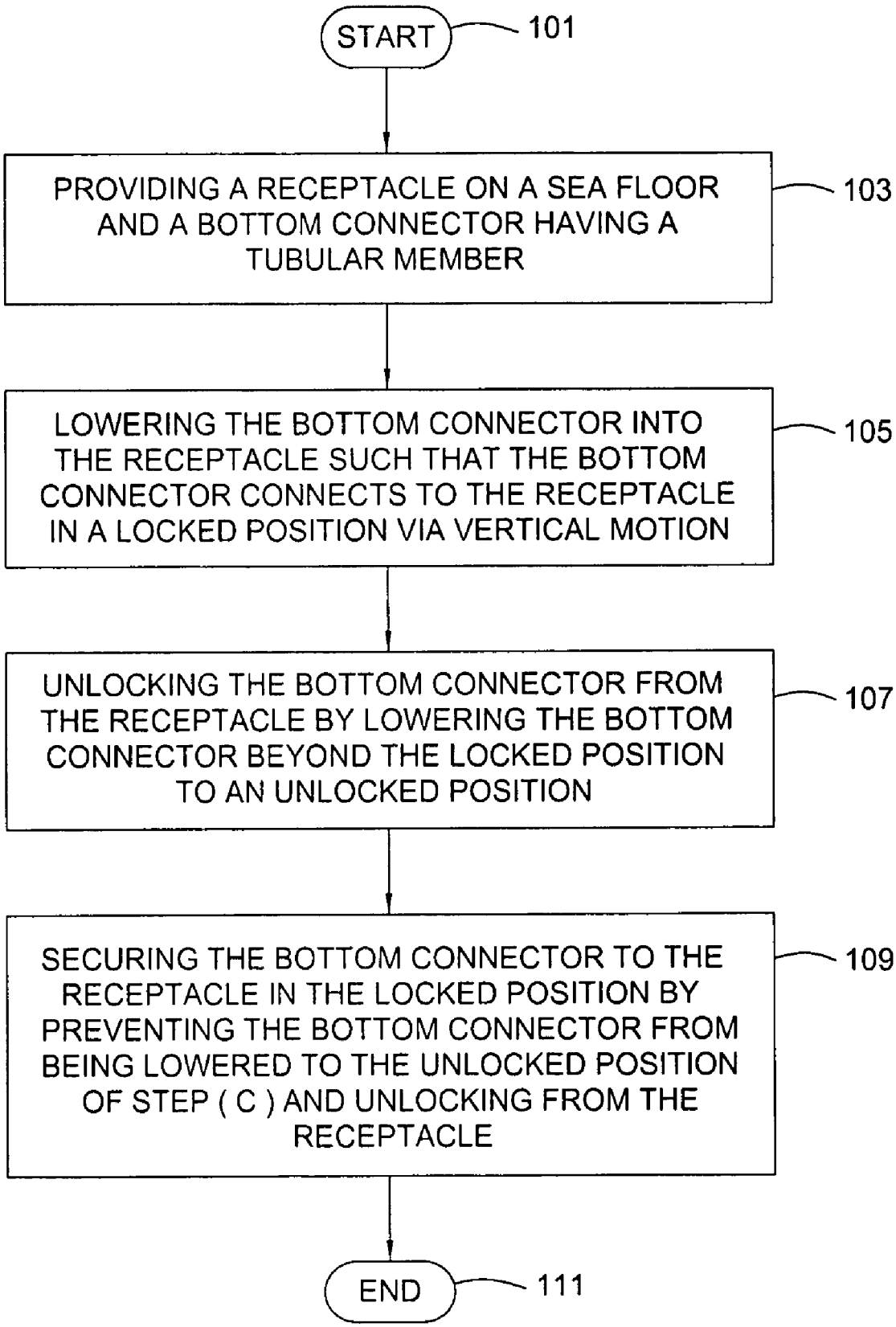
FIG. 8 is a high level flow diagram of one embodiment of a method constructed in accordance with the present invention.

Referring now to FIG. 8, one embodiment of a method of securing a mooring connection according to the invention is shown. The method begins as indicated at step 101, and may comprise providing a receptacle on a sea floor and a bottom connector having a tubular member (step 103); lowering the bottom connector into the receptacle such that the bottom connector connects to the receptacle in a locked position via vertical motion (step 105); unlocking the bottom connector from the receptacle by lowering the bottom connector beyond the locked position to an unlocked position (step 107); securing the bottom connector to the receptacle in the locked position by preventing the bottom connector from being lowered to the unlocked position of the previous step and unlocking from the receptacle (step 109); before ending as indicated at step 111.

One embodiment of the method also may comprise providing the tubular member of the bottom connector as one of a tendon and a riser. Step 109 may comprise extending radial members through the receptacle into engagement with the bottom connector, and/or moving the radial members to an engaged position that restrains the bottom connector from vertical motion relative to the receptacle; while further comprising moving the radial members to a disengaged position that permits vertical motion of the bottom connector relative to the receptacle in step 107.

The method may further comprise independently actuating the radial members with a device selected from the group consisting of a diver, remotely-operated vehicle (ROV), and a hydraulic drive mechanism. In another embodiment, the radial members comprise blocks having profiles, and extending the profiles through holes in the receptacle, such that the profiles on the blocks interface with mating profiles on the bottom connector that, in the engaged position, prevent the bottom connector from moving downward to prevent unlocking of the bottom connector relative to the receptacle.

The method may still further comprise mounting the blocks in boxes mounted exterior to the receptacle, and restraining the blocks from removal from the boxes in both the engaged and disengaged positions by locating pins that are attached to the receptacle; and/or using a pivotable gate mounted exterior to the receptacle for each radial member to selectively retain the radial members in both the engaged and disengaged positions; and/or using redundant pins on the pivotable gates for engaging and securing the pivotable gates in both the engaged and disengaged positions.

In addition, the method may further comprise positioning a sleeve on an exterior of the receptacle, and providing a key extending radially from an exterior surface of the receptacle and a stripe on the exterior surface of the receptacle and extending vertically downward from the key, forming an aperture in the sleeve and having a guide member for receiving the key and rotationally aligning the sleeve relative to the receptacle, facilitating rotational alignment with the stripe as the aperture is visible below the sleeve when the sleeve is lowered onto the receptacle, and the stripe providing visual reference to position the key in the guide member of the aperture.

While the invention has been shown or described in only some of its forms, it should be apparent to those skilled in the art that it is not so limited, but is susceptible to various changes without departing from the scope of the invention.

What is claimed is:

1. A system for securing a mooring connection, comprising:

a receptacle located on a sea floor;

a bottom connector having a tubular member extending therefrom to a platform at a sea surface, the bottom connector being secured to the receptacle, the bottom connector being connected to and disconnected from the receptacle via vertical motion, such that the bottom connector locks into the receptacle by being lowered into the receptacle to a locked position, and unlocks from the receptacle by being lowered beyond the locked position to an unlocked position;

securing means for preventing the bottom connector from being lowered to the unlocked position and unlocking from the receptacle; and a sleeve on an exterior of the receptacle, and a key extending radially from an exterior surface of the receptacle and a stripe on the exterior surface of the receptacle and extending vertically downward from the key, an aperture formed in the sleeve and having a guide member for receiving the key and rotationally aligning the sleeve relative to the receptacle, and the stripe facilitating rotational alignment with the aperture by being visible below the sleeve as the sleeve is lowered onto the receptacle, such that the stripe provides visual reference to position the key in the guide member of the aperture.

2. A system according to claim 1, wherein the tubular member of the bottom connector is one of a tendon and a riser.

3. A system according to claim 1, wherein the securing means is mounted to an exterior of the receptacle and extends radially through the receptacle into engagement with the bottom connector.

4. A system according to claim 1, wherein the securing means is separate and spaced apart from the bottom connector, and the securing means has an engaged position that restrains the bottom connector from vertical motion relative to the receptacle, and a disengaged position that permits vertical motion of the bottom connector relative to the receptacle.

5. A system according to claim 1, wherein the securing means comprises a plurality of radially movable members having an engaged position wherein the radially movable members restrain the bottom connector from vertical motion relative to the receptacle, and a disengaged position wherein the radially movable members permit vertical motion of the bottom connector relative to the receptacle.

6. A system according to claim 5, wherein the radially movable members are independently actuated by a device selected from the group consisting of a diver, remotely-operated vehicle (ROV), and a hydraulic drive mechanism.

7. A system according to claim 5, wherein each of the radially movable members comprises a block having a profile that extends through a hole in the receptacle, the profile on the block interfaces with a mating profile on the bottom connector and, in the engaged position, prevents the bottom connector from moving downward to prevent unlocking of the bottom connector relative to the receptacle.

8. A system according to claim 7, wherein each block is located inside a box mounted exterior to the receptacle, the blocks being restrained from removal from the boxes in both the engaged and disengaged positions by locating pins, and each of the locating pins being attached to the receptacle.

9. A system according to claim 5, further comprising a pivotable gate mounted exterior to the receptacle for each radially movable member, wherein the pivotable gates selectively retain the radially movable members in both the engaged and disengaged positions.

10. A system according to claim 9, wherein each radially movable member has a pair of spaced-part grooves for engagement by respective ones of the pivotable gates.

11. A system according to claim 9, further comprising a redundant pin for each of the pivotable gates for engaging and securing the pivotable gates in both the engaged and disengaged positions.

12. A system according to claim 7, wherein each block has an elliptical body that is complementary to an elliptical hole in the receptacle, and the block profile comprises a radial tooth having a downward-sloping upper surface and an upward sloping lower surface that exceeds an angle of inclination of the downward-sloping upper surface.

13. A system for securing a mooring connection, comprising:

a receptacle located on a sea floor and having an interior profile;

a bottom connector having a tubular member extending therefrom to a platform at a sea surface, the bottom connector being secured to the interior profile in the receptacle, the bottom connector being connected to and disconnected from the receptacle via vertical motion, such that the bottom connector locks into the receptacle by being lowered into the receptacle to a locked position, and unlocks from the receptacle by being lowered beyond the locked position to an unlocked position;

radially movable members mounted to an exterior of the receptacle for preventing the bottom connector from being lowered to the unlocked position and unlocking from the receptacle, the radially movable members having an engaged position whereby the radially movable members restrain the bottom connector from vertical motion relative to the receptacle, and a disengaged position whereby the radially movable members permit vertical motion of the bottom connector relative to the receptacle; and a pivotable gate mounted exterior to the receptacle for each radially movable member, wherein the pivotable gates selectively retain the radially movable members in both the engaged and disengaged positions.

14. A system according to claim 13, wherein the tubular member of the bottom connector is one of a tendon and a riser, and the radially movable members are separate and spaced apart from the bottom connector.

15. A system according to claim 13, wherein the radially movable members are independently actuated by a device selected from the group consisting of a diver, remotely-operated vehicle (ROV), and a hydraulic drive mechanism; and each of the radially movable members comprises a block having a profile that extends through a hole in the receptacle, the profile on the block interfaces with a mating profile on the bottom connector and, in the engaged position, prevents the bottom connector from moving downward to prevent unlocking of the bottom connector relative to the receptacle.

16. A system according to claim 15, wherein each block is located inside a box mounted exterior to the receptacle, the blocks being restrained from removal from the boxes in both the engaged and disengaged positions by locating pins, and each of the locating pins being attached to the receptacle.

17. A system according to claim 13, wherein each radially movable member has a pair of spaced-part grooves for engagement by respective ones of the pivotable gates; and a redundant pin for each of the pivotable gates for engaging and securing the pivotable gates in both the engaged and disengaged positions.

18. A system according to claim 15, wherein each block has an elliptical body that is complementary to an elliptical hole in the receptacle, and the block profile comprises a radial tooth having a downward-sloping upper surface and an upward sloping lower surface that exceeds an angle of inclination of the downward-sloping upper surface.

19. A system according to claim 13, further comprising a sleeve on an exterior of the receptacle, and a key extending radially from an exterior surface of the receptacle and a stripe on the exterior surface of the receptacle and extending vertically downward from the key, an aperture formed in the sleeve and having a guide member for receiving the key and rotationally aligning the sleeve relative to the receptacle, and the stripe facilitating rotational aligtunent with the aperture by being visible below the sleeve as the sleeve is lowered onto the receptacle, such that the stripe provides visual reference to position the key in the guide member of the aperture.

20. A method of securing a mooring connection, comprising:

(a) providing a receptacle on a sea floor and a bottom connector having a tubular member;

(b) lowering the bottom connector into the receptacle such that the bottom connector connects to the receptacle in a locked position via vertical motion;

(c) unlocking the bottom connector from the receptacle by lowering the bottom connector beyond the locked position to an unlocked position; and (d) securing the bottom connector to the receptacle in the locked position by preventing the bottom connector from being lowered to the unlocked position of step (c) and unlocking from the receptacle, comprising extending radial members through the receptacle into engagement with the bottom connector, moving the radial members to an engaged position that restrains the bottom connector from vertical motion relative to the receptacle; and further comprising moving the radial members to a disengaged position that permits vertical motion of the bottom connector relative to the receptacle for step (c), and using a pivotable gate mounted exterior to the receptacle for each radial member to selectively retain the radial members in both the engaged and disengaged positions.

21. A method according to claim 20, wherein step (a) comprises providing the tubular member of the bottom connector as one of a tendon and a riser.

22. A method according to claim 20, further comprising independently actuating the radial members with a device selected from the group consisting of a diver, remotely-operated vehicle (ROV), and a hydraulic drive mechanism.

23. A method according to claim 20, wherein the radial members comprise blocks having profiles, and extending the profiles though holes in the receptacle, such that the profiles on the blocks interface with mating profiles on the bottom connector that, in the engaged position, prevent the bottom connector from moving downward to prevent unlocking of the bottom connector relative to the receptacle.

24. A method according to claim 23, further comprising mounting the blocks in boxes mounted exterior to the receptacle, and restraining the blocks from removal from the boxes in both the engaged and disengaged positions by locating pins that are attached to the receptacle.

25. A method according to claim 20, further comprising using redundant pins on the pivotable gates for engaging and securing the pivotable gates in both the engaged and disengaged positions.

26. A method according to claim 20, further comprising positioning a sleeve on an exterior of the receptacle, and providing a key extending radially from an exterior surface of the receptacle and a stripe on the exterior surface of the receptacle and extending vertically downward from the key, forming an aperture in the sleeve and having a guide member for receiving the key and rotationally aligning the sleeve relative to the receptacle, facilitating rotational alignment with the stripe as the aperture is visible below the sleeve when the sleeve is lowered onto the receptacle, and the stripe providing visual reference to position the key in the guide member of the aperture.

* * * * *